United States Patent [19]

Klos et al.

[11] Patent Number: 4,705,576

[45] Date of Patent: Nov. 10, 1987

[54] ACIDIC CHROMIUM CONTAINING COATING SOLUTION FOR ZINC OR CADMIUM SURFACES

[75] Inventors: Klaus-Peter Klos; Karl-Heinz Lindemann, both of Trebur; Willi Birnstiel, Pfungstadt, all of Fed. Rep. of Germany

[73] Assignee: Elektro-Brite GmbH, Trebur/Industriegebiet, Fed. Rep. of Germany

[21] Appl. No.: 926,918

[22] Filed: Nov. 3, 1986

[30] Foreign Application Priority Data

Aug. 27, 1986 [DE] Fed. Rep. of Germany ..... 3629008

[51] Int. Cl.[4] ..... C23C 22/24; C04B 9/02

[52] U.S. Cl. ..... 148/6.2; 106/14.05; 427/305

[58] Field of Search ..... 106/14.05; 148/6.2; 427/305; 423/607

[56] References Cited

U.S. PATENT DOCUMENTS 2,563,431 8/1951 Spruance ..... 148/6.2

*Primary Examiner*—Theodore Morris

*Attorney, Agent, or Firm*—Kurt Kelman

[57] ABSTRACT

An aqueous acidic trivalent chromium and fluoride containing coating (passivating) solution for zinc, zinc alloy and cadmium surfaces contains one or more complex compounds of the formula $$[Cr(H_2O)_{6-x}F_x]^{(3-x)+}A^-$$

wherein x is an integer of from 1 to 3 and A is an anion of the group selected from nitrate, sulfate, phosphate, chloride, bromide, fluoride and iodide. In particular the solution contains a soluble nitrate in an amount greater than the cromium(III)concentration and before application the solution is either heated to at least 60° C. or treated with a catalyst at a temperature above 15° C.

11 Claims, No Drawings

ACIDIC CHROMIUM CONTAINING COATING SOLUTION FOR ZINC OR CADMIUM SURFACES

BACKGROUND OF THE INVENTION

The invention relates to an aqueous, acidic coating solution containing chromium for treating zinc, zinc alloy or cadmium surfaces, commonly called a passivating bath.

An acidic chromium containing coating solution for zinc and cadmium surfaces is known e.g. from U.S. Pat. No. 4,263,059 which contains besides trivalent chromium and an acid such as formic acid, acetic acid, propionic acid or nitric acid, sulfuric acid, hydrochloric acid and hydrofluoric acid, a fluoride, the trivalent chromium being formed from hexavalent chromium, such as chromium trioxide, alkali metal chromate and alkali metal dichromate and a reducing agent, such as an aldehyde or alcohol or an alkali metal sulfite, bisulfite, metabisulfite, iodide or of hydrogen peroxide, sulfur dioxide or a bivalent iron salt.

By treatment with this solution the surfaces of zinc, zinc alloy, zinc layers which have been electrocoated or coated by heat onto iron or steel, or surfaces of cadmium are much more corrosion resistant which is indicated by the development of a colour which may reach from blue to black and yellow up to olive green and which is used also for decorative purposes. In particular this coating such as the so-called blue-passivating layer which is a light blue coloured very thin passivating layer of a good decorative appearance inhibits largely the formation of zinc corrosion products also called "white rust".

A measure of the corrosion protection of this chromating is constituted by the salt spray test according to DIN 50021. This test involves subjecting a zinc coated and passivated metal part at 40° C. and 100% relative humidity to a 5% sodium chloride mist. The result is expressed in hours needed to oxidize 5 to 10% of the surface to white rust. The DIN 50021 values for blue passivating corrosion protection should amount from 20 to 24 hours.

The presence of toxic hexavalent chromium compounds in the coating bath of the prior art, however, enables hexavalent chromium to be included into the passivating layer which may lead to dermatitis when handling passivated zinc coated apparatuses e.g. in the food processing industry. Further waste water treatment for removing the remainder of such coating solutions and rinsing waste water, respectively, offers problems. The solutions are rather soon exhausted and can be regenerated only to a limited extent but must rather soon be removed. Corrosion protection obtainable by such solutions decreased within a short time, sometimes even after one day only.

Other acidic coating solutions containing trivalent chromium and also oxidizing agents (U.S. Pat. No. 4,171,231) and further additives, like silicates and/or other metal ions (U.S. Pat. Nos. 4,384,902; 4,359,347; 4,367,099) or organophosphorus compounds (U.S. Pat. No. 4,539,348) or carboxylic acids (U.S. Pat. No. 4,349,392) are suited to form decorative blue and yellow passivating layers but cannot be coloured afterwards and show corrosion test results according to DIN 50021 of a maximum of 6 hours for 10% white rust. Because of the presence of oxidizing agents the layers are not free from hexavalent chromium compounds which are in particular formed when increasing the pH during waste water treatment in the sedimentation step and which make decontamination more difficult.

SUMMARY OF THE INVENTION

It has been found that the disadvantages of the prior art of aqueous acidic chromium containing coating solutions for surfaces of zinc, zinc alloy and cadmium may be overcome by an aqueous acidic chromium containing coating solution which contains only trivalent chromium compounds but no oxidizing agents and no strong complexing agents. Such a solution was found to have a long shelf life, produces dyeable passivating layers and allows to easily adsorb organic polymers onto the passivating chromating layer.

DESCRIPTION OF THE PREFERRED EMBODIMENTS

The aqueous acidic chromium and fluoride containing coating solution for zinc, zinc alloy and cadmium of the invention is characterized in that it contains one or more complex compounds of the formula $$[Cr(H_2O)_{6-x}F_x]^{(3-x)+}A^- \quad (I)$$

wherein x is an integer of from 1 to 3 and A is an anion of the group selected from nitrate, sulfate, phosphate, chloride bromide, fluoride and iodide.

In particular the solution contains a soluble nitrate such as an alkali metal or earth metal nitrate or ammonium-nitrate in an amount greater than the concentration of trivalent chromium.

It has been found that the solution is particularly fast acting if it is heated before application for coating to at least 60° C. or if it is treated with a catalyst above 15° C. This treatment is preferably carried out with a concentrate of the solution before dilution to the concentration of application.

The treatment with a catalyst, in particular with active coal (charcoal or the like) at 15° C. or above that temperature e.g. at room temperature (20° to 25° C.) or the short heating for e.g. 30 seconds to 15 minutes to at least 60° C., preferably 60° to 80° C. appears to enhance formation of stable complex compounds of trivalent chromium. This is surprising since it is known from the literature that at room temperature only hexahydrate complexes of chromium are stable these complexes being unsuitable for chromating purposes. The possibility of the formation of fluorine containing chromium-(III)-aquo complexes is known per se (J. Am. Chem. Soc. 74 (1952) pages 3509–3512) but their activity for chromating (passivating) zinc is novel.

Preferred coating solutions according to the invention contain the following amounts in a concentrate that is usually applied in aqueous solution of 2 to 20% by weight:

20 to 200 gs/l of trivalent chromium compound such as chromium(III)chloride or chromium(III)nitrate, 20 to 600 gs/l of soluble nitrate such as sodium, potassium or ammoniumnitrate, 5 to 100 gs/l of fluoride, e.g. sodium, potassium, ammonium fluorids and hydrochloric acid or nitric acid in an amount to give a pH 1.8 to 2.2.

Chromating solutions prepared from this concentrate show corrosion protection values of a blue passivating layer according to DIN 50021 of 44 to 50 hours, good dyeability of the layers and good adherence of organic polymers to the layer.

EXAMPLE 1

A concentrate having the following composition was prepared:

50 gs/l of chromium(III)chloride
125 gs/l of sodium nitrate
50 gs/l of sodium fluoride, The concentrate was heated to 65° C. It contained complex compounds of the formula $$[Cr(H_2O)_{6-x}F_x]^{(3-x)}NO_3.$$

The solution was diluted with water in a weight ratio of 1:10 and nitric acid added until the pH amounted to 2.0.

Iron rods of 2 cm diameter and 20 cm length coated with zinc by hot-dipping were blue passivated by immersion into this solution. After 3 minutes the rods were removed from the bath and tested to corrosion properties according to DIN 50021. The anticorrosion value amounted to 48 hours.

EXAMPLE 2

A chromium coating solution consisting of
60 gs/l of $Cr(NO_3)_3 \cdot 9H_2O$,
100 gs/l of $NaNO_3$,
40 gs/l of NaF
$HNO_3$ ad pH 2.1 was prepared without heating but by treating it for 10 minutes with active coal granulate in a porous bag and then blending it with water in a weight ratio of 1:12 for the test as in Example 1. The solution contained complex compounds of the formula $$[Cr(H_2O)_{6-x}F_x]^{(3-x)}NO_3$$

The same corrosion protection value as in Example 1 was obtained.

A comparative test using a conventional blue passivating solution gave the following results:

Hexavalent chromium (commercial): 15 mg $Cr/m^2$ zinc; corrosion protection 24 hours.

trivalent chromium (invention): 30 mg $Cr/m^2$ zinc; corrosion protection 48 hours.

What we claim is:

1. An aqueous acidic chrome(III) and fluoride containing coating solution for treating zinc, zinc alloy or cadmium surfaces characterized in that it contains besides trivalent chromium ion, fluoride ion and an acid one or more complex compounds of the formula $$[Cr(H_2O)_{6-x}F_x]^{(3-x)+A-} \quad (I)$$

wherein x is an integer of 1 to 3 and A is an anion of the group selected of nitrate, sulfate, phosphate, chloride, bromide, fluoride and iodide.

2. Coating solution as claimed in claim 1, characterized in that it contains a soluble nitrate in an amount greater than the concentration of trivalent chromium ion.

3. Coating solution as claimed in claim 1 characterized in that before application for coating it has either been heated to a temperature of at least 60° C. or it has been treated with a catalyst at a temperature above 15° C.

4. Coating solution as claimed in claim 3 characterized in that the catalyst used is active coal.

5. Coating solution as claimed in claim 1 characterized in that the soluble nitrate is a nitrate of an alkali metal, of an earth alkali metal or of ammonium.

6. Coating solution as claimed in claim 1 characterized by the following composition:

20 to 200 gs/l of trivalent chromium compound,
20 to 600 gs/l of soluble nitrate,
5 to 100 gs/l of fluoride, hydrochloric or nitric acid to give a pH of 1.8 to 2.2.

7. Coating solution as claimed in claim 1 characterized by the following composition:

50 gs/l of chromium-(III)-fluoride
125 gs/l of sodium nitrate
50 gs/l of sodium fluoride nitric acid to give a pH of 2.0.

8. A method of treating a zinc surface, comprising the step of coating the zinc surface with a coating solution containing one or more complex compounds of the formula $$[Cr(H_2O)_{6-x}F_x]^{(3-x)+A-} \quad (I)$$

wherein x is an integer of 1 to 3 and A is an anion of the group selected of nitrate, sulfate, phosphate, chloride, bromide, fluoride and iodide.

9. The method of claim 8, wherein the coating solution contains trivalent chromium ion, fluoride ion and an acid.

10. A method of blue-passivating a zinc surface, comprising the step of coating the zinc surface with an aqueous coating solution containing 2 to 20%, by weight, of one or more complex compounds of the formula $$[Cr(H_2O)_{6-x}F_x]^{(3-x)+A-} \quad (I)$$

wherein x is an integer of 1 to 3 and A is an anion of the group selected of nitrate, sulfate, phosphate, chloride, bromide, fluoride and iodide.

11. The method of claim 10, wherein the coating solution contains trivalent chromium ion, fluoride ion and an acid.

* * * * *